United States Patent [19]

Wren, Jr. et al.

[11] 4,361,970

[45] Dec. 7, 1982

[54] KARATE FOOT PROTECTOR

[75] Inventors: Fred H. Wren, Jr.; Frank H. Babcock, III, both of St. Louis, Mo.

[73] Assignee: Pro-Tect, Inc., St. Louis, Mo.

[21] Appl. No.: 190,880

[22] Filed: Sep. 25, 1980

[51] Int. Cl.[3] ..... A43B 5/00; A43B 19/00

[52] U.S. Cl. ..... 36/106; 36/114; 36/50; 36/53

[58] Field of Search ..... 36/2 R, 96, 97, 102, 36/106, 113, 114, 92, 50, 51, 72 R, 53; 2/18

[56] References Cited

U.S. PATENT DOCUMENTS

| | | | |
|---|---|---|---|
| 3,769,722 | 11/1973 | Rhee | 36/2 R |
| 4,051,613 | 10/1977 | Collins | 36/114 |
| 4,103,437 | 8/1978 | Dillard | 36/106 |
| 4,168,584 | 9/1979 | Wren et al. | 36/114 X |
| 4,190,971 | 3/1980 | Wren et al. | 36/114 X |
| 4,287,610 | 9/1981 | Rhee | 2/18 |

*Primary Examiner*—Richard J. Scanlan, Jr.
*Attorney, Agent, or Firm*—Cohn, Powell & Hind

[57] ABSTRACT

This foot protector includes a front portion providing protection for the toes and instep of the wearer and a rear portion protecting the ankles and heel, the protector being open at the bottom. The rear portion of the protector includes heel side margins extending downwardly from the top of the protector and terminating upwardly of the bottom to define separable side flap portions and a connecting lower portion for the rear side portions. The heel side margins include arcuate interconnected lower portions and an integrally formed reinforcing pad extends transversely of said side margins. A connector element releasably connects the separable side flap portions.

3 Claims, 5 Drawing Figures

KARATE FOOT PROTECTOR

BACKGROUND OF THE INVENTION

This invention relates generally to a foot protector for karate combat and other martial art sports and particularly to a protector having a rear access entry for the foot.

Some form of foot protector is necessary in almost all forms of martial art sports and particularly in karate combat. It is particular desirable that protective shoes of the kind under consideration be constructed so that they can be readily placed on, and removed from, the foot easily and yet are securely held on the foot during use.

Protective shoes of this kind are known in the prior art and are disclosed for example in U.S. Pat. No. 4,168,584 and U.S. Pat. No. 4,190,971 commonly owned by the present assignee. Both of these patents disclose karate foot protectors utilizing full length lacing systems to facilitate entry of the foot. Laces have proven desirable under some circumstances because of the tendency for tearing of the shoe material when the separable portions of the protector, necessary for entry of the foot, do not extend the full height of the shoe. However, while this system is satisfactory for many purposes it does require that the laces be hand tied.

The present foot protector eliminates the need for tie laces without rendering the protector susceptible to tearing.

SUMMARY OF THE INVENTION

This foot protector for karate combat can be removed and replaced easily without damage to the protector and without sacrifice of comfort.

The foot protector includes a unitary body formed from a resilient foam core material having a flexible outer casing, the body including a front portion adapted to cover the upper portion of the foot and the sides thereof; an open bottom portion defined by a lower margin; a rear portion adapted to cover the ankle of the foot, including opposed side portions and an upper margin. The side portions include opposed heel side margins extending downwardly from the upper margin and terminating upwardly of the lower margin to define separable upper side flap portions, and a connecting lower portion and a strap connector element releasably connecting the upper side flap portions.

In one aspect of the invention the heel side margins include arcuate interconnected lower portions.

In another aspect of the invention the connecting lower portion includes an integrally formed reinforcing pad extending transversely of the heel side margins.

In still another aspect of the invention the heel side margins include a straight upper portion and arcuate lower portion cooperating to define a generally keyholed-shaped configuration and the connecting portion includes an integrally formed generally kidney-shaped pad extending around at least the greater portion of the arcuate portion of the heel side margins.

DESCRIPTION OF THE PREFERRED EMBODIMENT

Figure 1:
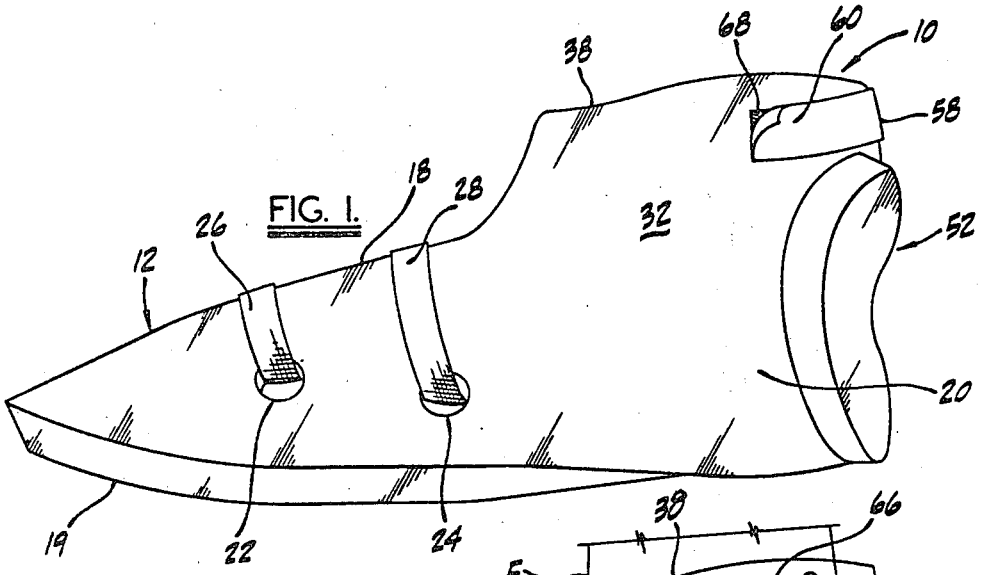
FIG. 1 is a side elevational view of the foot protector.
Figure 2:
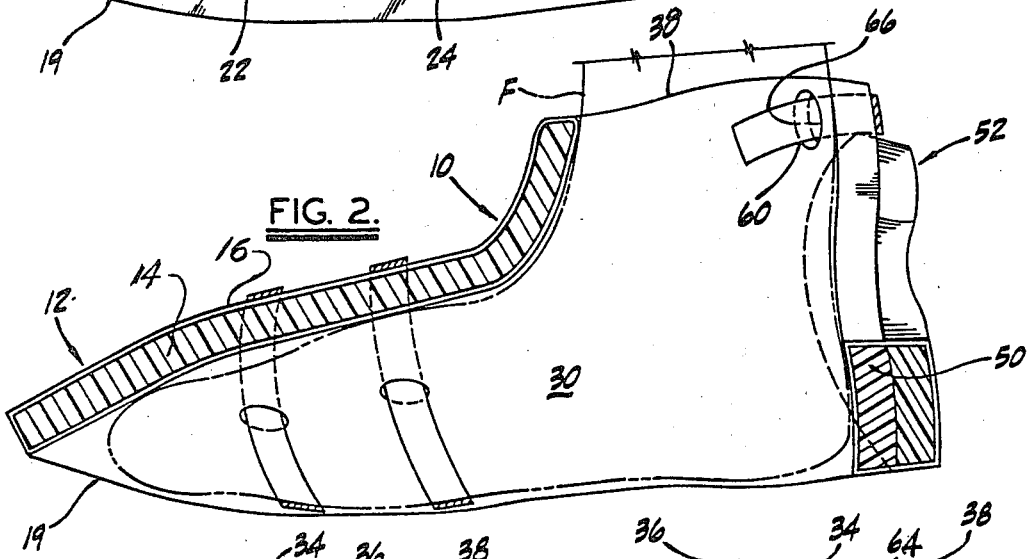
FIG. 2 is a longitudinal cross sectional view thereof.
Figure 3:
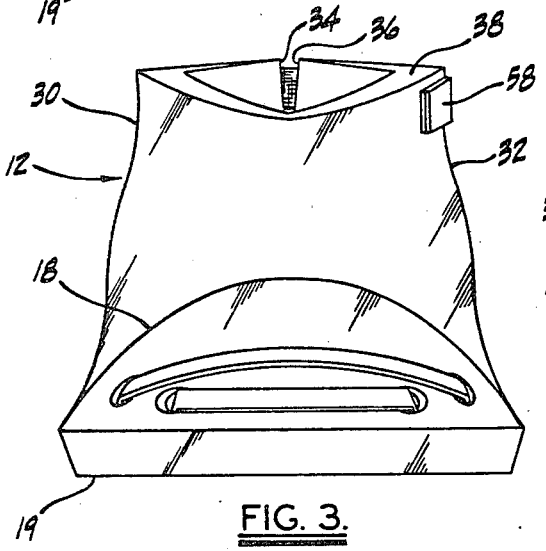
FIG. 3 is a front end elevational view thereof.
Figure 4:
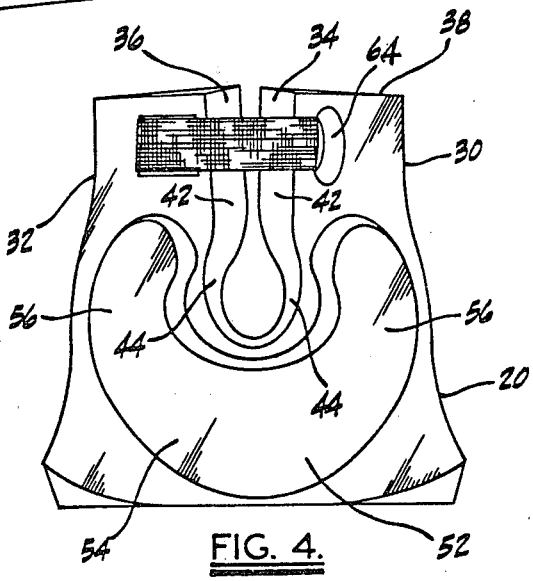
FIG. 4 is a rear end elevational view thereof.

Referring now by reference numerals to the drawings and first to FIGS. 1 and 2 it will be understood that the foot protector, generally indicated by numeral 10, comprises essentially a unitary body 12 having an inner core 14 of resilient material such as rubber foam or the like, and a flexible outer casing 16 formed by dipping the core into liquid polyvinyl chloride, or the like.

The body 12 includes a front portion 18 covering the instep or upper portion of the foot F, the toes and the front sides of said foot. The body also includes a wrap-around rear portion 20 which is integrally formed with the front portion 18 and is adapted to cover the ankle and at least part of the heel portion of the foot F. The bottom of the body 12, defined by a circumferential lower margin 19 is open.

The body front portion 18 is provided with opposed pairs of front and rear spaced openings 22 and 24 respectively which receive associated substantially continuously elastic bands 26 and 28 which in the preferred embodiment encircle the forward portion of the foot F.

The body rear portion 20 includes opposed side portions 30 and 32 constituting outer and inner portions respectively. Both of the side portions 30 and 32 extend rearwardly from the front portion 18, with which they are unitarily formed, to join at the rear heel end of the body 12.

At the heel end, the side portions 30 and 32 each include opposed heel side margins 34 and 36 extending downwardly from the body upper margin 38 and terminating upwardly of the lower margin 19. In the embodiment shown, each heel margin 34 and 36 includes an upper, generally straight portion 42 and a generally arcuate lower portion 44, said portions cooperating to define a generally keyhole-shaped configuration. The heel side margins 34 and 36, in effect, define separable side flap portions 46 and 48 shown in phantom outline in FIG. 5 and a connecting lower portion 50.

The rear portion 20 also includes an integrally formed reinforcing pad 52 which, in the preferred embodiment, is attached to the rear portion of the core 14 as by adhesive, prior to dipping said core. The pad 52, in the preferred embodiment, is generally of a kidney-shaped configuration having a transversely extending portion 54 and also upwardly extending portions 56, generally conforming to the arcuate lower margin portions 44.

A strap connector element 58 is provided at the upper portion of the heel side margins 34 and 36, which extends between and releasably connects the side flaps 46 and 48. In the embodiment shown, the connector element 58 is a nylon pile fastener having one connecting portion 60 received within an opening 66 provided adjacent the margin 34 and attached to the inside of side flap 46, as by adhesive, and a cooperating portion 68 attached by adhesive to the outside of flap 48, one of said cooperating pile fastener portions being provided with a wool-like surface and the other being provided with a releasably attachable hook-like surface.

Figure 5:
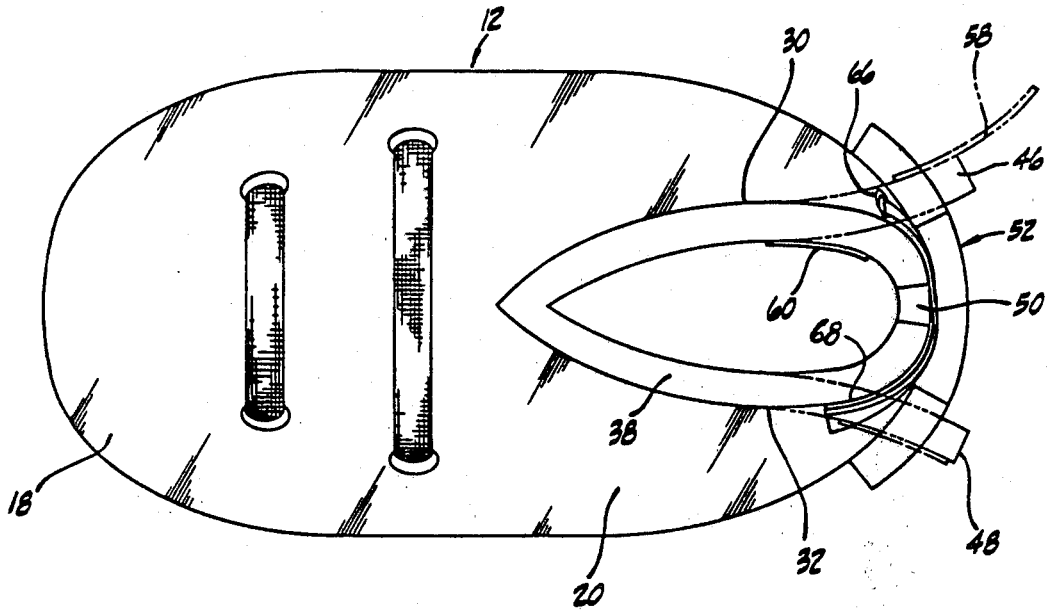
FIG. 5 is a top plan view thereof.

As will be readily understood, the foot protector 10 is exceedingly easy to use. To put the protector on, the strap connector element portions 60 and 68 are disconnected and each of the flaps 46 and 48 held between the finger and thumb of one hand so that they can be bent outwardly, as shown in FIG. 5, to permit entry of the foot F. The keyhole configuration of the heel side margins 34 and 36 and the reinforcing provided by the pad 52 cooperate to prevent tearing of the otherwise vulnerable connecting lower heel portion 50, said pad also providing additional heel cushioning. The strap connector elements are readily adjustable to a comfortable fit for the wearer.

We claim as our invention:

1. A foot protector, for karate combat comprising:

(a) a unitary body formed from a resilient foam core having a flexible outer casing, the body including:

1. a front portion adapted to cover the upper portion of the foot and the front sides thereof,
2. an open bottom portion defined by a lower margin,
3. a rear portion adapted to cover the ankle of one foot, including opposed side portions and an upper margin,
4. said side portions including opposed heel side margins extending downwardly from the upper margin and terminating upwardly of the lower margin to define separable upper side flap portions, outwardly bendable to permit entry of the foot, and a continuous connecting lower portion disposed about the lower heel, and
5. a strap connector element releasably connecting the upper side flap portions.

2. A foot protector, for karate combat comprising:

(a) a unitary body formed from a resilient foam core having a flexible outer casing, the body including:

1. a front portion adapted to cover the upper portion of the foot and the front sides thereof,
2. an open bottom portion defined by a lower margin,
3. a rear portion adapted to cover the ankle of one foot, including opposed side portions and an upper margin,
4. said side portions including opposed heel side margins extending downwardly from the upper margin and terminating upwardly of the lower margin to define separable upper side flap portions and a connecting lower portion, and
5. a strap connector element releasably connecting the upper side flap portions, and (b) the connecting lower portion of the side portions including an integrally formed reinforcing pad extending transversely of the heel side margins and substantially thickening the connecting portion directly below the separable upper flap side portions.

3. A foot protector for karate combat as defined in claim 2, in which:

(c) said heel side margins include a generally straight upper portion and a generally arcuate lower portion cooperating to define a generally keyhole-shaped configuration, and (d) the lower connecting portion reinforcing pad is generally kidney-shaped and extends upwardly around at least the greater portion of the said arcuate portion of the heel side margins.

* * * * *